US006895630B2

(12) United States Patent
Tini

(10) Patent No.: US 6,895,630 B2
(45) Date of Patent: May 24, 2005

(54) TOOTHBRUSH COMPRISING MAGNETIC ELEMENTS

(75) Inventor: Paolo Giuseppe Tini, Chur (CH)

(73) Assignee: Grital Anstalt, Vaduz (LI)

( * ) Notice: Subject to any disclaimer, the term of this patent is extended or adjusted under 35 U.S.C. 154(b) by 63 days.

(21) Appl. No.: 10/369,648

(22) Filed: Feb. 21, 2003

(65) Prior Publication Data

US 2003/0172482 A1 Sep. 18, 2003

(30) Foreign Application Priority Data

Feb. 21, 2002 (EP) ..... 02 405 127

(51) Int. Cl.[7] ..... A46B 9/04; A61N 2/00

(52) U.S. Cl. ..... 15/167.1; 15/105; 15/246; 600/9

(58) Field of Search ..... 15/167.1, 105, 15/246; 601/15; 600/9, 15

(56) References Cited

U.S. PATENT DOCUMENTS

| | | | | |
|---|---|---|---|---|
| 4,571,768 A | | 2/1986 | Kawashima | |
| 4,682,584 A | | 7/1987 | Pose | |
| 5,389,981 A | * | 2/1995 | Riach, Jr. | 351/158 |

FOREIGN PATENT DOCUMENTS

| | | |
|---|---|---|
| DE | 38 15 593 | 11/1989 |
| GB | 2 117 230 | 10/1983 |
| JP | 05-023219 | 2/1993 |
| JP | 11-113638 | 4/1999 |
| RU | 1755799 | 8/1992 |
| RU | 1833174 | 8/1993 |
| RU | 2077349 | 4/1997 |

OTHER PUBLICATIONS

"Wellness Tools—Quantron Resonance System"; http://www.wellnesstools.com/qrs_more.php.*
"Magnet Healing"; http://www.aznewage.com/magnetic.htm.*
"Magnetic Grooming Supplies"; http://www.buyamag.com/grooming.php.*
English Abstract of RU 2109475, Apr. 27, 1998.

* cited by examiner

*Primary Examiner*—Robert J. Warden, Sr.
*Assistant Examiner*—Laura C Cole
(74) *Attorney, Agent, or Firm*—Oblon, Spivak, McClelland, Maier & Neustadt, P.C.

(57) ABSTRACT

A toothbrush has, on the brush head (1), a negative end magnetic pole (5), lateral magnetic poles (6*a,b*) of opposite polarities and upper magnetic poles (7*a–c*) which have alternately opposite polarities, that of the foremost magnetic pole (7*a*) differing from that of the end magnetic pole (5). The field strength at the surface of the toothbrush is between 600 and 1500 Gauss in the vicinity of a magnetic pole. The magnetic poles (5, 6*a,b,* 7*a–c*) are produced by magnetic plates (4*a–f*) integrally cast close to the surface. Instead of being let directly into the brush head, the magnetic plates can also be let into an attachment which can be pushed onto a conventional toothbrush.

14 Claims, 1 Drawing Sheet

TOOTHBRUSH COMPRISING MAGNETIC ELEMENTS

FIELD OF THE INVENTION

The invention relates to a toothbrush comprising magnetic elements.

PRIOR ART

U.S. Pat. No. 4,682,584 discloses a toothbrush of the generic type for magnetic field therapy in the oral cavity, in which a rod-shaped magnet is arranged in the brush head. However, the locations of the poles of the magnet and hence the nature of the magnetic field produced by it are unclear.

GB-A-2 117 230 describes toothbrushes having various arrangements of magnetic poles at the top and at the sides of the brush head, which are said to reduce the deposition of tartar and similar incrustations on the teeth. However, none of the toothbrushes has a magnetic pole at the end face of the brush head.

SUMMARY OF THE INVENTION

It is the object of the invention to provide a toothbrush of the generic type which during cleaning of the teeth, the toothbrush according to the invention applies relatively strong magnetic fields especially at the front face and the sides of the brush head. In particular, the toothbrush according to the invention acts on the oral vestibular and retromolar points. The requirements for effective therapy of various complaints can often thus be provided.

A further object of the invention is to provide an attachment by means of which a conventional magnet-free toothbrush can be converted into a toothbrush according to the invention. An attachment according to the invention permits the separation of the function of the magnetic elements from the cleaning function of the rapidly wearing toothbrush, so that the latter can be replaced without it being necessary to replace the magnetic elements too. It can therefore be used for a very long time in an economical and environmentally friendly manner.

BRIEF DESCRIPTION OF THE DRAWINGS

The invention is explained in more detail below with reference to figures which show only embodiments.

DESCRIPTION OF THE PREFERRED EMBODIMENTS

Figure 1:
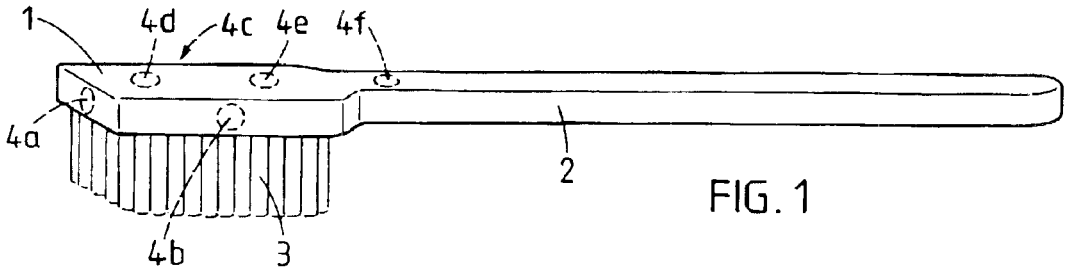
FIG. 1 shows a perspective view of a first embodiment of a toothbrush according to the invention.
Figure 2:
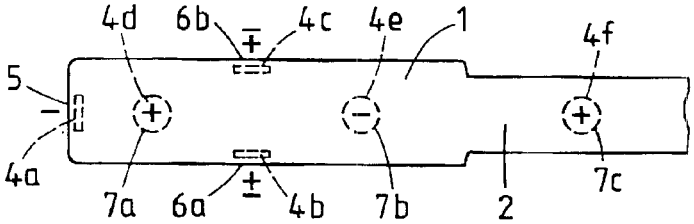
FIG. 2 shows a schematic view of the arrangement of magnetic poles on the toothbrush according to FIG. 1.

According to the first embodiment (FIGS. 1, 2), the brush according to the invention has a brush head 1 to whose rear end an integral handle 2 is connected and which carries bristles 3 on its underside. It consists of plastic, e.g. synthetic resin, and is produced by the injection moulding process. A plurality of magnetic elements are cast integrally close to the surface, but hermetically enclosed in the brush head 1. They are preferably in the form of commercial flat cylindrical magnetic plates 4*a–f* which carry a positive pole on one side and a negative pole on the opposite side and whose field strength in the vicinity of the poles is between 600 and 1500 Gauss. The magnetic plates 4*a–f* are in each case just below the surface, which one of their sides faces. They therefore each produce a magnetic pole on the surface of the brush head 1. The magnetic poles in turn generate a magnetic field in its environment, depending on their arrangement and orientation.

A magnetic plate 4*a* cast integrally in the middle of the end face of the brush head 1 generates there (FIG. 2) an end magnetic pole 5, preferably a negative pole, while magnetic plates 4*b,c* cast integrally on both sides approximately in the middle of the sides produce lateral magnetic poles 6*a,b* which preferably have opposite polarities. This arrangement generates a relatively strong field in the front region of the brush head 1 and at the sides of and above said brush head. Consequently, substantially the entire oral cavity is passed over by the magnetic field during cleaning of the teeth. Instead of the two magnetic plates 4*b,c,* a rod magnet which produces the two poles can also be integrally cast. Moreover, it is of course possible to provide more than one lateral magnetic pole each, it also being possible for lateral magnetic poles to be present in the front handle region.

In order to amplify the magnetic field above the brush head 1, the further magnetic plates 4*d,e,f* which produce upper magnetic poles 7*a,b,c* at the surface are integrally cast, at the top of said brush head, the foremost magnetic pole 7*a* located before the middle of the brush head 1 having a polarity opposite to that of the end magnetic pole 5, i.e. being a positive pole in the case described. Of the further upper magnetic poles 7*b,c,* the first one located behind the middle of the brush head 1 has a polarity opposite to that of the foremost magnetic pole 7*a,* i.e. is a negative pole, while the second one located in the front handle region itself in turn has the opposite polarity, i.e. is a positive pole. It is possible to provide even more upper magnetic poles at the top of the brush head 1 and of the handle 2, the polarities of which preferably alternate continuously. The distance between directly successive magnetic plates from midpoint to midpoint is preferably about 2.54 cm, which corresponds to one inch. The magnetic poles at the top of the toothbrush can incidentally also serve for fastening said toothbrush to a bathroom cabinet or another unit.

Figure 3A:
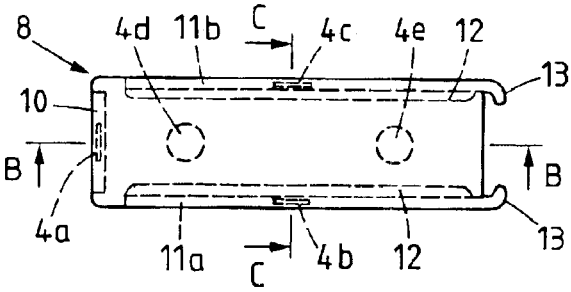
FIG. 3*a* shows a plan view of an attachment according to the invention.
Figure 3B:
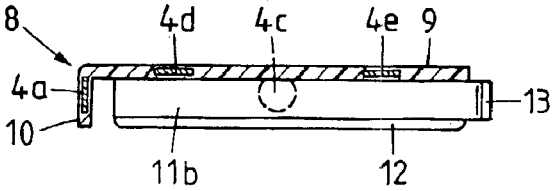
FIG. 3*b* shows a section according to B—B in FIG. 3*a*.
Figure 3C:
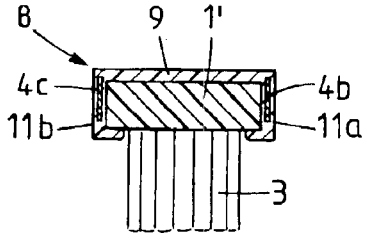
FIG. 3*c* shows a section according to C—C in FIG. 3*a*, supplemented by a magnet-free toothbrush to which the attachment is connected

An attachment 8 (FIGS. 3*a–c*) provided with integrally cast magnetic elements, in particular magnetic plates 4*a–e,* in substantially the same way as the toothbrush described can be used for converting a conventional magnet-free toothbrush into a composite toothbrush according to the invention. The toothbrush, which is relatively rapidly worn, can therefore be changed as often as required while the attachment containing the magnetic elements can be used for a very long time. This makes its use particularly economical and environmentally friendly. Moreover, the attachment can be used with different brushes which differ, for example, in the hardness and arrangement of the bristles.

The attachment 8 has a top plate 9 into which the magnetic plates 4*d,e* are integrally cast and which carries at the front an end plate 10 projecting at right angles and containing the magnetic plate 4*a,* as well as, laterally, corresponding side plates 11*a,b* containing the magnetic plates 4*b,c.* The side plates 11*a,b* each carry at their lower edges an inward-projecting locking strip 12 which grips under the brush head 1' (FIG. 3*c*) of the magnet-free brush and at their rear end inward-projecting locking wings 13 which grip behind the brush head 1' for fixing the attachment 8 to the brush head. The attachment 8 can be pushed onto the brush head 1' from the end until the locking wings 13 snap in behind said brush head or can be pushed on from above until the locking strips 12 snap in under the brush head 1'. The attachment 8 is then removable, but reliably fastened to the toothbrush. However, other methods of fastening can of course also be used. Thus, for example, the brush head may contain ferromagnetic material so that the magnetic elements simultaneously serve for fixing the attachment to said brush head or at least support said fixing. It is also possible to connect the handle to the attachment and to provide interchangeable brush heads.

Moreover, it is also possible to offer a set of attachments which differ according to arrangement or polarity of the magnetic poles.

Figure 4:
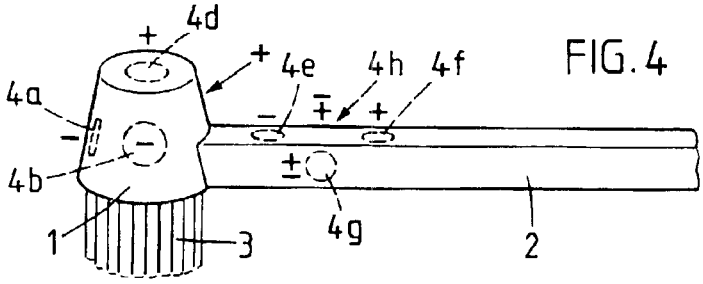
FIG. 4 shows a perspective view of a second embodiment of a toothbrush according to the invention.

In the case of a toothbrush according to a further embodiment (FIG. 4), the brush head 1 is round and is fastened to the handle in such a way that it executes a preferably oscillating rotational movement. The electric drive required for this purpose can be mounted in the handle 2 or in the brush head 1 itself. Magnetic plates 4*a–f* are mounted similarly to the toothbrush according to the first embodiment, but the further magnetic plates 4*e,f* are both integrally cast at the top of the handle 2. The polarities once again alternate. The distances between successive magnetic plates can once again be about 2.54 cm. Two further magnetic plates 4*g,h* which are located between the magnetic plates 4*e* and 4*f* with respect to the distance from the brush head 1 are mounted opposite one another, on the sides of the handle 2. Not only does the driven brush head 1 effect intense, partly automatic cleaning, but the action of a part of the magnetic field is also improved since larger spatial regions are covered without any particular action on the part of the user. The brush may have a case which is connected to the handle and carries the magnetic elements and into which the brush head, in this case free of magnets, can be inserted so that it can easily be changed.

LIST OF REFERENCE SYMBOLS

1 Brush head
2 Handle
3 Bristles
4*a–h* Magnetic plates
5 End magnetic pole
6*a,b* Lateral magnetic poles
7*a–c* Upper magnetic poles
8 Attachment
9 Top plate
10 End plate
11*a,b* Side plates
12 Locking strips
13 Locking wings

What is claimed is:

1. Toothbrush comprising:

a handle;

a brush head connecting to said handle, carrying bristles on its underside; and magnetic elements for generating a magnetic field in the vicinity of the brush head, including at least one end magnetic pole arranged at a front distal end of the brush head opposite a handle distal end, and at least one pair of lateral magnetic poles arranged at both sides of the brush head.

2. Toothbrush according to claim 1, wherein the at least one end magnetic pole is a negative pole.

3. Toothbrush according to claim 1, comprising:

the at least one pair of lateral magnetic poles which are opposite one another have opposite polarities.

4. Toothbrush according to claim 1, comprising:

at least one foremost upper magnetic pole arranged at a top of the brush head.

5. Toothbrush according to claim 4, comprising:

at least one further upper magnetic pole arranged at the top of the brush head or of a rear portion of the brush head said further upper magnetic pole being displaced from the at least one end magnetic pole towards the handle.

6. Toothbrush according to claim 5, wherein the polarity of the at least one further upper magnetic pole is opposite to that of at least one adjacent upper magnetic pole, wherein the upper magnetic poles form a sequence of at least two poles of alternate opposite polarities.

7. Toothbrush according to claim 1, wherein the end and lateral magnetic poles comprise:

permanent magnets having opposite sides which carry a positive pole and a negative pole, respectively.

8. Toothbrush according to claim 7, wherein the brush head and the handle comprise of plastic and the magnetic elements are completely surrounded thereby.

9. Toothbrush according to claim 7, wherein said permanent magnets comprise flat magnetic plates.

10. Toothbrush according to claim 7, wherein the magnetic elements are embedded in the brush head and the handle.

11. Toothbrush according to claim 1, wherein the field strength at the surface of the toothbrush in the vicinity of the end and lateral magnetic poles is between 600 Gauss and 1500 Gauss.

12. Toothbrush according to claim 1, wherein the brush head is fastened to the handle in such a way that it can execute an oscillating rotational movement.

13. Toothbrush according to any one of claims 1 to 12, comprising:

an attachment including said front and lateral side magnetic elements and configured to be connected to said brush head.

14. Toothbrush according to claim 13, wherein said magnetic elements for generating a magnetic field in a vicinity of the brush head are mounted on a brush head.

* * * * *